United States Patent [19]

Treptow et al.

[11] 4,060,476

[45] Nov. 29, 1977

[54] ANODE FOR ELECTROCHEMICAL PROCESSES

[75] Inventors: Wolfram Treptow, Ludwigshafen; Gerd Wunsch, Speyer, both of Germany

[73] Assignee: BASF Aktiengesellschaft, Ludwigshafen (Rhine), Germany

[21] Appl. No.: 640,575

[22] Filed: Dec. 15, 1975

[30] Foreign Application Priority Data

Dec. 30, 1974 Germany ..... 2461800

[51] Int. Cl.[2] ..... C25B 11/04; C25B 11/16

[52] U.S. Cl. ..... 204/290 F; 204/291; 204/128

[58] Field of Search ..... 204/290 F, 291

[56] References Cited

U.S. PATENT DOCUMENTS

| | | | |
|---|---|---|---|
| 3,649,485 | 3/1972 | Chisholm | 204/95 |
| 3,663,280 | 5/1972 | Lee | 427/126 |
| 3,915,837 | 10/1975 | Feige | 204/286 |

FOREIGN PATENT DOCUMENTS

| | | | |
|---|---|---|---|
| 83,339 | 7/1971 | Germany | 204/290 F |
| 886,197 | 1/1962 | United Kingdom | 204/290 F |
| 289,823 | 2/1971 | U.S.S.R. | 204/290 F |

*Primary Examiner*—F.C. Edmundson

*Attorney, Agent, or Firm*—Keil, Thompson & Shurtleff

[57] ABSTRACT

An anode for electrochemical processes consists of an electrode base plate of a metal which can be passivated electrochemically, a protective layer deposited thereon, and a further layer, consisting of manganese dioxide. The protective layer consists of the nitride of the metal of the electrode base plate.

7 Claims, 5 Drawing Figures

ANODE FOR ELECTROCHEMICAL PROCESSES

The present invention relates to the manufacture of maganese dioxide electrodes, which do not comprise a noble metal, for use in inorganic and organic electrosynthesis.

Manganese dioxide is of great interest as an anode material for both inorganic electro-synthesis, because of the low oxygen overvoltage and halogen overvoltage of anodes which contain it. Usually, the $MnO_2$ is directly deposited electrochemically, or by thermal decomposition, onto an electrode base plate of a metal such as titanium which can be passivated anodically. When these electrodes are employed in electrolyses, the potential, and hence the cell voltage, rise progressively since a passive layer of, for example, titanium dioxide builds up between the titanium base and the manganese dioxide layer.

The formation of this passive layer can be repressed by the conventional method of coating the base material with a noble metal of the platinum group, or by a complicated process entailing the application of a mixture of aluminum oxide powder and iron powder at temperatures of about 1,000° C in a high vacuum. The disadvantage of these two known processes is, respectively, the high cost of the noble metal layers and the complicated method of producing the ferrous layers in relation to the comparatively short life of the electrodes.

It is an object of the present invention to provide anodes for electrochemical processes containing manganese dioxide as electrochemically active material, the anodes being applied over a protective layer on electrode base plates of a metal which can be passivated electrochemically, which anodes are distinguished by a simple method of manufacture and by long life.

We have found that this object is achieved if the protective layer essentially consists of the nitride of the metal of the base plate.

The electrode base plate consists, in the conventional way, of a metal which can be passivated, eg. titanium, zirconium, hafnium, vanadium, niobium, tantalum or an alloy of these metals with one another, but especially of titanium or of alloys of titanium with other metals which can be passivated, the said alloys preferably containing not less than 50% by weight of titanium.

The nitriding of the electrode base plate is carried out by conventional methods. Thus, eg., the electrode can be treated in a nitrogen atmosphere at from 1,100° to 1,300° C or in an ammonia atmosphere at from 800° to 1,000° C. Treatment with chloramine at from 325° to 650° C has also been disclosed. A final possibility is to bring the electrode base plate, heated to from 500° to 700° C, into contact with a mixture of titanium tetrachloride and ammonia, whereupon nitride deposits on the hot surface.

The thickness of the nitride layer is advantageously from about 1 to 10$\mu$.

The layer containing manganese dioxide as the electrochemically active material can be deposited on the nitride layer thus formed, either electrochemically or, according to a particularly preferred embodiment, by thermal decomposition of manganese (II) salts in the presence of oxygen. Suitable manganese salts are salts of divalent manganese which can be decomposed at from 100° C to 650° C, eg. the halides, formate, oxalate, acetate, sulfate, sulfide or carbonate, but above all the nitrate or a mixture of these and especially mixtures of the nitrate with one or more other decomposable salts.

Manganese compounds which can be decomposed directly without first melting, or which have melting points higher than the $MnO_2$ decomposition temperature, eg. $MnSO_4$, $MnCl_2$, MnS or $MnCO_3$, are preferably suspended in melts of salts of melting point less than 650° C, to ensure satisfactory application to the Ti/TiN base. Preferred melts are those which oxidize the manganese salt, eg. nitrates of the alkali metals, which may also be used in the form of eutectics, eg. with alkali metal hydroxides or other alkali metal nitrates, eg. $NaNO_3$/NaOH (weight ratio 1:1), $LiNO_3$ (38 mole %)/$KNO_3$ or $NaNO_3$(45 mole %)/$KNO_3$. The decomposable manganese salts are used as a 50 to 90 percent by weight suspension in these melts. To improve the Mn:O ratio during formation of the $MnO_2$, the electrodes may be treated with $Cl_2$ or with oxygen or air containing ozone, during or after coating. This is of advantage, eg., when $MnO_2$ electrodes are manufactured from manganese acetate, manganese formate and manganese oxalate. Particularly good results are achieved if the manganese salt on the surface on which it is to be decomposed, is rapidly brought to the decomposition temperature, ie. within the space of less than 60 seconds and advantageously of less than 30 seconds. When the manganese dioxide is formed in this way, a special bond is evidently formed between the manganese dioxide and the nitride layer below it, giving electrodes of long life and extremely low loss of manganese dioxide. Thus, eg., with a 10$\mu$ thick layer of manganese dioxide, a current density of 5 A/dm$^2$ and 10 percent strength by weight sulfuric acid as the electrolyte, a life of more than 35,000 A.hr, and an $MnO_2$ loss of only about $2.0 \times 10^{-2}$ mg/A.hr.dm$^2$ are readily achieved. A titanium/manganese dioxide electrode without a protective layer, and with the same thickness of manganese dioxide layer shows a constantly rising potential, a life of only 6,000 A. hr and an $MnO_2$ loss of $2 \times 10^{-1}$ mg/A.hr.dm$^2$. If a noble metal protective layer is used, with a 50$\mu$ thick layer of $MnO_2$, a life of only 10,000 A.hr (5A/dm$^2$) is achievable in 10 percent strength by weight sulfuric acid. If the titanium surface is saturated with iron in accordance with Russian Pat. No. 360,966 and a 50$\mu$ thick layer of manganese dioxide is then applied, the life increases to at most 22,000 A.hr at 5A/dm$^2$.

The thickness of the manganese dioxide layer is advantageously about 10 to 40$\mu$. When the desired decomposition temperature has been reached, the electrode is suitably left for from 0.5 to 1 hour at this temperature and is then cooled to room temperature.

The electrode according to the invention can be employed as the anode in electrolyses, eg. in HCl, $H_2SO_4$ or NaOH electrolysis, in anodic oxidation in organic electrochemistry and, above all, as an anode for the formation of chlorine, eg, in the electrolysis of alkali metal chlorides.

EXAMPLE

A piece of expanded titanium metal (surface area = 1 dm$^2$) is provided with a titanium nitride interface by 15 minutes' treatment in a $NH_4Cl$ atmosphere, free from oxygen and $H_2O$, in an oven at 380° C. The titanium must be degreased, and cleaned with HF or oxalic acid, before the nitriding treatment. After the nitriding treatment, the expanded metal is sprayed with a melt of Mn $(NO_3)_2 \cdot 6H_2O$. The thermal decomposition to $MnO_2$ takes place in air at 300° C. After a period of heating of at most 30 seconds, the electrode is left for 0.5 hour in an oven at a constant temperature of 300° C. It is then cooled to room temperature. The desired thickness of the layer, namely 10μ, is achieved by repeating this procedure 10 times.

$Cl_2$ potential and $O_2$ potential in a molar solution of HCl and a molar solution of $H_2SO_4$ respectively, at the $Ti/TiN/MnO_2$ electrode; 10μ thick layer; $i = 100$ mA/cm². Reference electrode $U_S = Hg/HgSO_4$; $T = 25°$ C.

Electrolyte: molar $H_2SO_4$ $U_S = +1395$ mV

Electrolyte: molar HCl $U_S = +1360$ mV

The life of the electrode in 10 percent strength $H_2SO_4$ at 30° C is found to be 35,000 A.hr ($i = 5$ A/dm²; thickness of $MnO_2$ layer = 10μ). The fluctuations in potential do not exceed ± 20 mV.

We claim:

1. An anode suitable for use in electrochemical process and comprising an electrode base plate made of a metal which can be passivated electrochemically, a protective layer of the nitride of the metal of the electrode base plate applied thereto, and a layer containing manganese dioxide as electrochemically active material and overlying the protective layer, said last-mentioned layer having been produced by applying over the protective nitride layer of the electrode base plate a thermally decomposable manganese salt and decomposing said salt to form manganese dioxide by rapidly bringing the salt, after its application over the protective nitride layer, to its decomposition temperature in a period of less than 60 seconds.

2. An anode as claimed in claim 1 wherein the electrode base plate is made of titanium or of an alloy of titanium with one or more other metals which can be passivated.

3. An anode as claimed in claim 1 wherein the protective layer has a thickness of from 1 to 10μ.

4. An anode as claimed in claim 1 wherein the manganese dioxide layer has a thickness of from 10 to 40μ.

5. An anode as claimed in claim 1 wherein the electrode base plate is made of titanium or of an alloy of titanium with one or more other metals which can be passivated, which other metals are selected from the group consisting of zirconium, hafnium, vanadium, niobium and tantalum.

6. An anode as claimed in claim 1 wherein said period is less than 30 seconds.

7. An anode as claimed in claim 1 wherein said manganese salt is the formate, acetate, oxalate, sulfate, sulfide, carbonate or nitrate of a divalent manganese or a manganese (II) halide.

* * * * *